US006902390B2

(12) United States Patent
Spicer

(10) Patent No.: US 6,902,390 B2
(45) **Date of Patent: *Jun. 7, 2005**

(54) BURNER TIP FOR PRE-MIX BURNERS

(75) Inventor: David B. Spicer, Houston, TX (US)

(73) Assignee: ExxonMobil Chemical Patents, Inc., Houston, TX (US)

( * ) Notice: Subject to any disclaimer, the term of this patent is extended or adjusted under 35 U.S.C. 154(b) by 126 days.

This patent is subject to a terminal disclaimer.

(21) Appl. No.: 10/388,994

(22) Filed: Mar. 14, 2003

(65) Prior Publication Data

US 2004/0241601 A1 Dec. 2, 2004

Related U.S. Application Data

(60) Provisional application No. 60/365,223, filed on Mar. 16, 2002.

(51) Int. Cl.[7] ..... F23D 14/00
(52) U.S. Cl. ..... 431/5; 431/9
(58) Field of Search ..... 431/5, 9, 115, 431/215; 126/91 A

(56) References Cited

U.S. PATENT DOCUMENTS

| | | | |
|---|---|---|---|
| 2,368,370 | A | 1/1945 | Maxon |
| 2,813,578 | A | 11/1957 | Ferguson |
| 2,918,117 | A | 12/1959 | Griffin |
| 2,983,312 | A | 5/1961 | Finley et al. |
| 3,880,570 | A | 4/1975 | Marshall |
| 4,004,875 | A | 1/1977 | Zink et al. |
| 4,089,629 | A | 5/1978 | Baumgartner et al. |
| 4,130,388 | A | 12/1978 | Flanagan |
| 4,230,445 | A | 10/1980 | Janssen |
| 4,257,763 | A | 3/1981 | Reed |

(Continued)

FOREIGN PATENT DOCUMENTS

| | | |
|---|---|---|
| CA | 1169753 | 6/1984 |
| DE | 2944153 | 5/1981 |
| DE | 3232421 | 3/1984 |
| DE | 3818265 | 11/1989 |
| EP | 0099828 | 6/1988 |

(Continued)

OTHER PUBLICATIONS

Sirtiz III, John F., et al., "Combat NOs With Better Burner Design," *Chemical Engineering, Nov. 1994*, pp. EE–4–EE–8.

(Continued)

*Primary Examiner*—Alfred Basichas

(57) ABSTRACT

An improved burner and a method for combusting fuel in burners used in furnaces such as those found in steam cracking. The burner includes a burner tube having a longitudinal axis and having a downstream end and an upstream end for receiving fuel gas and air, flue gas or mixtures thereof, a fuel orifice located adjacent the upstream end of the burner tube, for introducing fuel gas into the burner tube, a burner tip mounted on the downstream end of the burner tube and adjacent a first opening in the furnace, the burner tip having a plurality of main ports substantially aligned with said longitudinal axis of the burner tube, and a plurality of peripherally arranged side ports and an peripheral tile which peripherally surrounds the burner tip, leaving at least one gap between an outer periphery of the burner tip and the peripheral tile, the at least one gap effective for providing a portion of the air for combustion wherein the quantity of fuel gas discharged during combustion from the peripherally arranged side ports does not exceed 15% of the total fuel gas combusted. Reducing the quantity of the fuel gas discharged from the side ports during burner operation is effective to reduce $NO_x$ emissions during combustion over a similar burner utilizing a conventional burner tip design.

28 Claims, 9 Drawing Sheets

U.S. PATENT DOCUMENTS

| | | | | | |
|---|---|---|---|---|---|
| 4,575,332 | A | | 3/1986 | Oppenberg et al. | |
| 4,629,413 | A | | 12/1986 | Michelson et al. | |
| 4,708,638 | A | | 11/1987 | Brazier et al. | |
| 4,739,713 | A | | 4/1988 | Vier et al. | |
| 4,748,919 | A | | 6/1988 | Campobenedetto et al. | |
| 4,815,966 | A | | 3/1989 | Janssen | |
| 4,828,483 | A | | 5/1989 | Finke | |
| 4,963,089 | A | | 10/1990 | Spielman | |
| 4,995,807 | A | | 2/1991 | Rampley et al. | |
| 5,044,931 | A | | 9/1991 | Van Eerden et al. | |
| 5,073,105 | A | | 12/1991 | Martin et al. | |
| 5,092,761 | A | | 3/1992 | Dinicolantonio | |
| 5,098,282 | A | | 3/1992 | Schwartz et al. | |
| 5,135,387 | A | | 8/1992 | Martin et al. | |
| 5,152,463 | A | | 10/1992 | Mao et al. | |
| 5,154,596 | A | | 10/1992 | Schwartz et al. | |
| 5,195,884 | A | | 3/1993 | Schwartz et al. | |
| 5,201,650 | A | | 4/1993 | Johnson | |
| 5,224,851 | A | | 7/1993 | Johnson | |
| 5,238,395 | A | | 8/1993 | Schwartz et al. | |
| 5,254,325 | A | * | 10/1993 | Yamasaki et al. | 423/450 |
| 5,263,849 | A | | 11/1993 | Irwin et al. | |
| 5,269,679 | A | | 12/1993 | Syska et al. | |
| 5,275,554 | A | | 1/1994 | Faulkner | |
| 5,284,438 | A | | 2/1994 | McGill et al. | |
| 5,299,930 | A | | 4/1994 | Weidman | |
| 5,316,469 | A | | 5/1994 | Martin et al. | |
| 5,326,254 | A | | 7/1994 | Munk | |
| 5,344,307 | A | | 9/1994 | Schwartz et al. | |
| 5,350,293 | A | | 9/1994 | Khinkis et al. | |
| 5,370,526 | A | | 12/1994 | Buschulte et al. | |
| 5,407,345 | A | | 4/1995 | Robertson et al. | |
| 5,413,477 | A | | 5/1995 | Moreland | |
| 5,470,224 | A | | 11/1995 | Bortz | |
| 5,472,341 | A | | 12/1995 | Meeks | |
| 5,542,839 | A | | 8/1996 | Kelly | |
| 5,562,438 | A | | 10/1996 | Gordon et al. | |
| 5,584,684 | A | | 12/1996 | Dobbeling et al. | |
| 5,603,906 | A | | 2/1997 | Lang et al. | |
| 5,611,682 | A | | 3/1997 | Slavejkov et al. | |
| 5,624,253 | A | | 4/1997 | Sulzhik et al. | |
| 5,685,707 | A | * | 11/1997 | Ramsdell et al. | 431/90 |
| 5,688,115 | A | * | 11/1997 | Johnson | 431/9 |
| 5,807,094 | A | | 9/1998 | Sarv | |
| 5,813,846 | A | * | 9/1998 | Newby et al. | 431/9 |
| 5,980,243 | A | | 11/1999 | Surbey et al. | |
| 5,984,665 | A | | 11/1999 | Loftus et al. | |
| 5,987,875 | A | | 11/1999 | Hilburn et al. | |
| 5,993,193 | A | | 11/1999 | Loftus et al. | |
| 6,007,325 | A | | 12/1999 | Loftus et al. | |
| 6,056,538 | A | | 5/2000 | Büchner et al. | |
| 6,332,408 | B2 | * | 12/2001 | Howlett et al. | 110/189 |
| 6,347,935 | B1 | | 2/2002 | Schindler et al. | |
| 6,383,462 | B1 | * | 5/2002 | Lang | 423/235 |
| 6,616,442 | B2 | | 9/2003 | Venizelos et al. | |

FOREIGN PATENT DOCUMENTS

| | | |
|---|---|---|
| EP | 0 347 956 | 12/1989 |
| EP | 0 374 423 | 6/1990 |
| EP | 0 408 171 A1 | 1/1991 |
| EP | 0 507 233 | 10/1992 |
| EP | 0 620 402 A1 | 10/1994 |
| EP | 0 674 135 B2 | 9/1995 |
| EP | 0 751 343 | 1/1997 |
| EP | 0486169 | 1/1998 |
| EP | 1096202 | 2/2001 |
| FR | 2629900 | 10/1988 |
| RU | 374488 | 5/1970 |

OTHER PUBLICATIONS

Vahdahl, M. M., et al., "Design And Development of A Low NOx Coanda Ejector Burnes," *Journal of the Institute of Energy*, Mar. 2000, vol. 73, pp. 12–17.

Butsman, Wes,, et al., "Low NOx Burner Technology for Ethylene Cracking Furnaces," presented at eh *2001 AICHE Spring National Meeting, 13th Annual Ethylene Producer; Conference*, Houston, TX, Apr. 25, 2001, pp. 1–23.

Seebold, James G., "Reduce Healer NOs in the Burner," *Hydrocarbon Processing*, Nov. 1982, pp. 183–186.

"West Germany's Caloric Develops a Low–NOx Reccling Fuel Burner," *Chemical Engineering*, Oct. 4, 1982, p. 17.

Abstract of EP 0 507 233 published on Oct. 7, 1992, entitled "Burner fo Liquid Fuels".

Chemical Engineering Progress, vol. 43, 1947, "The Design of Jet Pumps" by A. Edgar Kroll, pp. 21–24, vol. 1, No. 2.

* cited by examiner

BURNER TIP FOR PRE-MIX BURNERS

RELATED APPLICATIONS

This patent application claims priority from Provisional Application Ser. No. 60/365,223, filed on Mar. 16, 2002, the contents of which are hereby incorporated by reference.

FIELD OF THE INVENTION

This invention relates to an improvement in a burner of the type employed in high temperature industrial furnaces. More particularly, it relates to an improved burner tip design capable of achieving a reduction in $NO_x$ emissions.

BACKGROUND OF THE INVENTION

As a result of the interest in recent years to reduce the emission of pollutants from burners of the type used in large industrial furnaces, significant improvements have been made in burner design. In the past, burner design improvements were aimed primarily at improving heat distribution. Increasingly stringent environmental regulations have shifted the focus of burner design to the minimization of regulated pollutants.

Oxides of nitrogen ($NO_x$) are formed in air at high temperatures. These compounds include, but are not limited to, nitrogen oxide and nitrogen dioxide. Reduction of $NO_x$ emissions is a desired goal to decrease air pollution and meet government regulations.

The rate at which $NO_x$ is formed is dependent upon the following variables: (1) flame temperature, (2) residence time of the combustion gases in the high temperature zone and (3) excess oxygen supply. The rate of formation of $NO_x$ increases as flame temperature increases. However, the reaction takes time and a mixture of nitrogen and oxygen at a given temperature for a very short time may produce less $NO_x$ than the same mixture at a lower temperature, over a longer period of time.

Strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763. Also, many raw gas burners produce luminous flames.

Premix burners mix some or all of the fuel with some or all of the combustion air prior to combustion. Since premixing is accomplished by using the energy present in the fuel stream, airflow is largely proportional to fuel flow. As a result, therefore, less frequent adjustment is required.

Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

One technique for reducing $NO_x$ that has become widely accepted in industry is known as combustion staging. With combustion staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Combustion staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while CO emissions, an indication of incomplete combustion, may actually increase as well.

The majority of recent low $NO_x$ burners for gas-fired industrial furnaces is based on the use of multiple fuel jets in a single burner. Such burners may employ fuel staging, flue-gas recirculation, or a combination of both. U.S. Pat. Nos. 5,098,282 and 6,007,325 disclose burners using a combination of fuel-staging and flue-gas recirculation. Certain burners may have as many as 8–12 fuel nozzles in a single burner. The large number of fuel nozzles requires the use of very small diameter nozzles. In addition, the fuel nozzles of such burners are generally exposed to the high temperature flue-gas in the firebox.

In the high temperature environment of steam-cracking furnaces used for the manufacture of ethylene, the combination of small diameter fuel nozzles and exposure to high temperature flue gas can lead to fouling and potential plugging of the fuel jets. This not only has an adverse impact on burner performance, but also increases the cost of maintenance associated with repeated cleaning of fuel nozzles.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

U.S. Pat. No. 4,629,413 discloses a low $NO_x$ premix burner and discusses the advantages of premix burners and methods to reduce $NO_x$ emissions. The premix burner of U.S. Pat. No. 4,629,413 lowers $NO_x$ emissions by delaying the mixing of secondary air with the flame and allowing some cooled flue gas to recirculate with the secondary air. The contents of U.S. Pat. No. 4,629,413 are incorporated by reference in their entirety.

U.S. Pat. No. 5,092,761 discloses a method and apparatus for reducing $NO_x$ emissions from premix burners by recirculating flue gas. Flue gas is drawn from the furnace through a pipe or pipes by the aspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The flue gas recirculating system may be retrofitted into existing premix burners or may be incorporated in new low $NO_x$ burners. The contents of U.S. Pat. No. 5,092,761 are incorporated by reference in their entirety.

An advantage of the staged-air pre-mix burners disclosed in U.S. Pat. Nos. 4,629,413 and 5,092,761 relates to their use of a single fuel nozzle. This permits the size of the fuel nozzle to be the maximum possible for a given burner firing duty. In addition, since the fuel nozzle is located at the inlet to the venturi, it is not exposed directly to either the high temperature flue-gas or the radiant heat of the firebox. For these reasons the problems of fuel nozzle fouling are minimized, providing a significant advantage for the staged-air pre-mix burner in ethylene furnace service.

An additional challenge to the designer of low $NO_x$ burners is to maintain adequate flame stability. The very techniques used to minimize $NO_x$ emissions reduce flame temperature and flame speed, and generally lead to less stable flames which are more prone to "lift-off." "Lift-off" is a term used to describe a flame where the zone of combustion has left the burner tip. In extreme cases, lift-off can lead to instances of flame-out; where combustion at the burner is extinguished. Such a condition is highly undesirable as it can potentially lead to an accumulation of an air/fuel mixture in the firebox.

From the standpoint of $NO_x$ production, a drawback with respect to the presence of localized sources of high $NO_x$ production has been discovered which is associated with the burner tip design of the burner of U.S. Pat. No. 5,092,761.

Despite these advances in the art, a need exists for a highly efficient burner design for industrial use to meet increasingly stringent $NO_x$ emission regulations, which minimizes localized sources of high $NO_x$ production.

Therefore, what is needed is a burner for the combustion of fuel and air wherein localized sources of high $NO_x$ production are substantially eliminated, yielding further reductions in $NO_x$ emissions.

SUMMARY OF THE INVENTION

The present invention is directed to an improved burner and to a method for combusting fuel in burners used in industrial furnaces such as those found in steam cracking. The burner includes a burner tube having a longitudinal axis and having a downstream end and an upstream end for receiving fuel gas and air, flue gas or mixtures thereof, a fuel orifice located adjacent the upstream end of the burner tube, for introducing fuel gas into the burner tube, a burner tip mounted on the downstream end of the burner tube adjacent a first opening in the furnace, the burner tip having a plurality of main ports substantially aligned with said longitudinal axis of the burner tube, and a plurality of peripherally arranged side ports and a peripheral tile which peripherally surrounds the burner tip, leaving at least one gap between an outer periphery of the burner tip and the peripheral tile, the at least one gap effective for providing a portion of the air for combustion wherein the quantity of fuel gas discharged during combustion from the peripherally arranged side ports does not exceed 15% of the total fuel gas combusted. Reducing the quantity of the fuel gas discharged from the side ports during burner operation is effective in reducing $NO_x$ emissions.

The method of the present invention includes the steps of combining fuel gas and air at a predetermined location adjacent a fuel orifice, passing the fuel gas and air, flue gas or mixtures thereof through a burner tube, discharging the fuel gas and air at a burner tip downstream of the predetermined location, the burner tip having a plurality of main ports arranged on an upper surface thereof, and a plurality of peripherally arranged side ports, the burner tip peripherally surrounded by a peripheral tile, and combusting said fuel gas downstream of the burner tip downstream of said predetermined location, wherein the quantity of fuel gas discharged during combustion from said peripherally arranged side ports does not exceed 15% of the total fuel gas combusted.

The method of the present invention may also include the steps of providing at least one gap between an outer periphery of said burner tip and the peripheral tile, the at least one gap providing a portion of the air for combustion, drawing a stream of flue gas from the furnace in response to the aspirating effect of uncombusted fuel gas exiting the fuel orifice and flowing towards the combustion zone, the flue gas mixing with the air at the predetermined location upstream of the zone of combustion, and mixing air having a temperature lower than the temperature of the flue gas with the stream of flue gas and drawing the mixture of the lower temperature air and flue gas, to the predetermined location, to thereby lower the temperature of the drawn flue gas.

An object of the present invention is to provide a burner configuration wherein localized sources of high $NO_x$ production are substantially reduced, yielding further reductions in $NO_x$ emissions.

A further object of the present invention is to substantially reduce a zone of high oxygen concentration adjacent to the at least one gap, reducing $NO_x$ emissions.

A yet further object is to provide a burner tip design capable of reducing $NO_x$ production, while still providing a stable flame that is not prone to lift-off.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF THE ILLUSTRATED EMBODIMENTS

Figure 1:
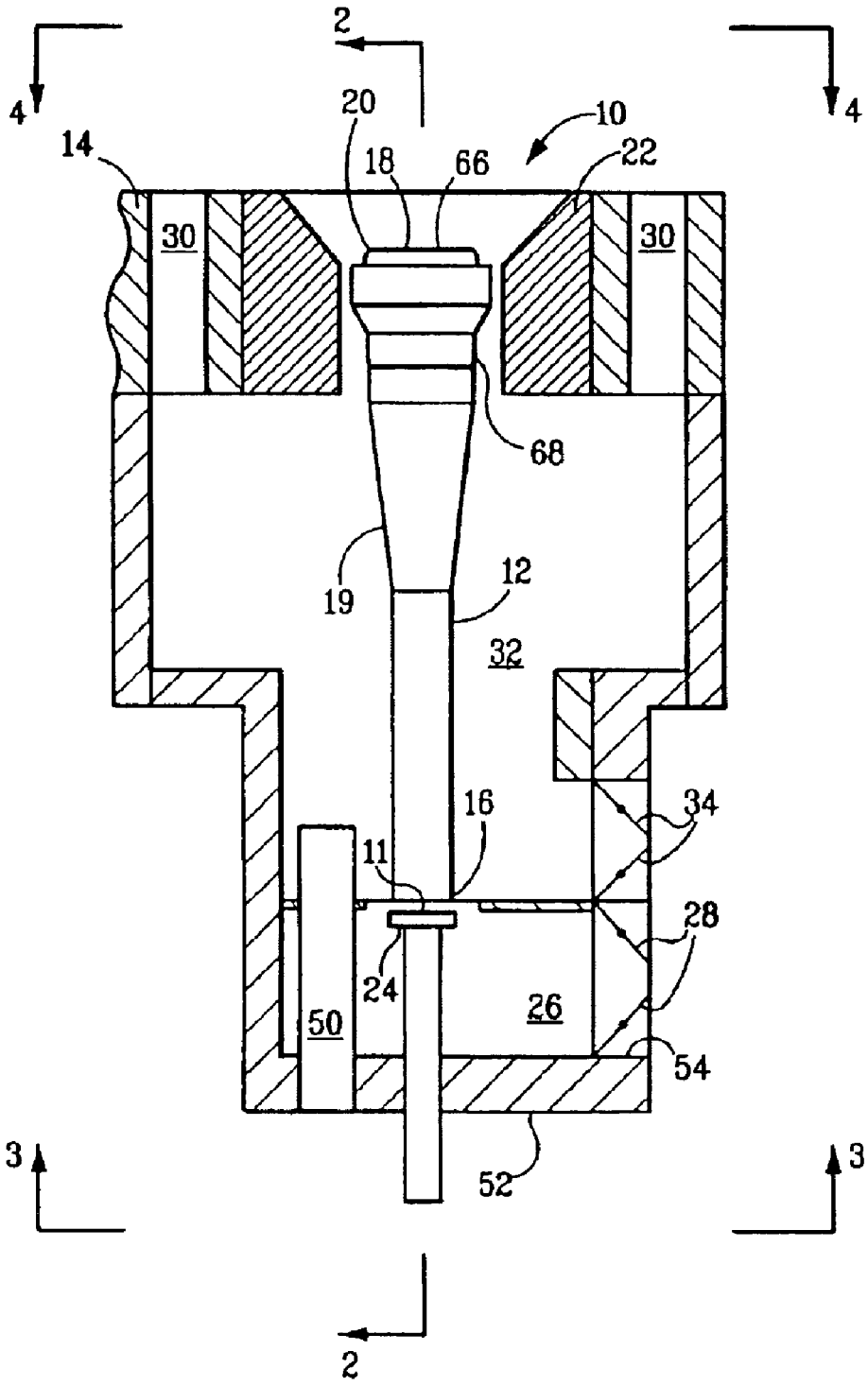
FIG. 1 illustrates an elevation partly in section of an embodiment of the burner of the present invention.

Reference is now made to the embodiments illustrated in FIGS. 1 through 11, wherein like numerals are used to designate like parts throughout.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring now to FIGS. 1 through 4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by a peripheral tile 22. A fuel orifice 11, which may be located within a gas spud 24, is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion occurs downstream of burner tip 20.

Referring still to FIGS. 1 through 4, burner tip 20 has an upper end 66, which when installed, faces the furnace box, and a lower end 68 adapted for mating with the burner tube 12. Lower end 68 of burner tip 20 may be mated to burner tube 12 by welding, swaging or threaded engagement, with welding or threaded engagement being particularly preferred. In operation, side-ports 62 direct a fraction of the fuel gas across the face of peripheral tile 22, while main ports 64 direct the major portion of the fuel gas into the furnace. In a conventional burner tip, side ports are provided about the entire periphery of the outer edge of the burner tip.

A plurality of air ports 30 originates in secondary air chamber 32 and pass through furnace floor 14 into the furnace. Fresh air enters secondary air chamber 32 through adjustable dampers 34 and passes through staged air ports 30 into the furnace to provide secondary or staged combustion, as described in U.S. Pat. No. 4,629,413.

In order to recirculate flue gas from the furnace to the primary air chamber, ducts or pipes 36, 38 extend from openings 40, 42, respectively, in the floor of the furnace to openings 44, 46, respectively, in burner plenum 48. Flue gas containing, for example, about 0 to about 15% $O_2$ is drawn through pipes 36, 38 with about 5 to 15% $O_2$ preferred, about 2 to about 10% $O_2$ more preferred and about 2 to about 5% $O_2$ particularly preferred, by the aspirating effect of fuel gas passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature, and as a result, reducing $NO_x$ emissions. Closing or partially closing damper 28 restricts the amount of fresh air that can be drawn into the primary air chamber 26 and thereby provides the vacuum necessary to draw flue gas from the furnace floor 14.

Unmixed low temperature ambient air, having entered secondary air chamber 32 through dampers 34 and having passed through air ports 30 into the furnace, is also drawn through pipes 36, 38 into the primary air chamber by the aspirating effect of the fuel gas passing through venturi portion 19. The ambient air may be fresh air as discussed above. The mixing of the ambient air with the flue gas lowers the temperature of the hot flue gas flowing through pipes 36, 38 and thereby substantially increases the life of the pipes and permits use of this type of burner to reduce $NO_x$ emission in high temperature cracking furnaces having flue gas temperature above 1900° F. in the radiant section of the furnace.

It is preferred that a mixture of from about 20% to about 80% flue gas and from about 20% to about 80% ambient air should be drawn through pipes 36, 38. It is particularly preferred that a mixture of about 50% flue gas and about 50% ambient air be employed. The desired proportions of flue gas and ambient air may be achieved by proper sizing, placement and/or design of pipes 36, 38 in relation to air ports 30, as those skilled in the art will readily recognize. That is, the geometry of the air ports, including but not limited to their distance from the burner tube, the number of air ports, and the size of the air ports, may be varied to obtain the desired percentages of flue gas and ambient air.

Figure 2:
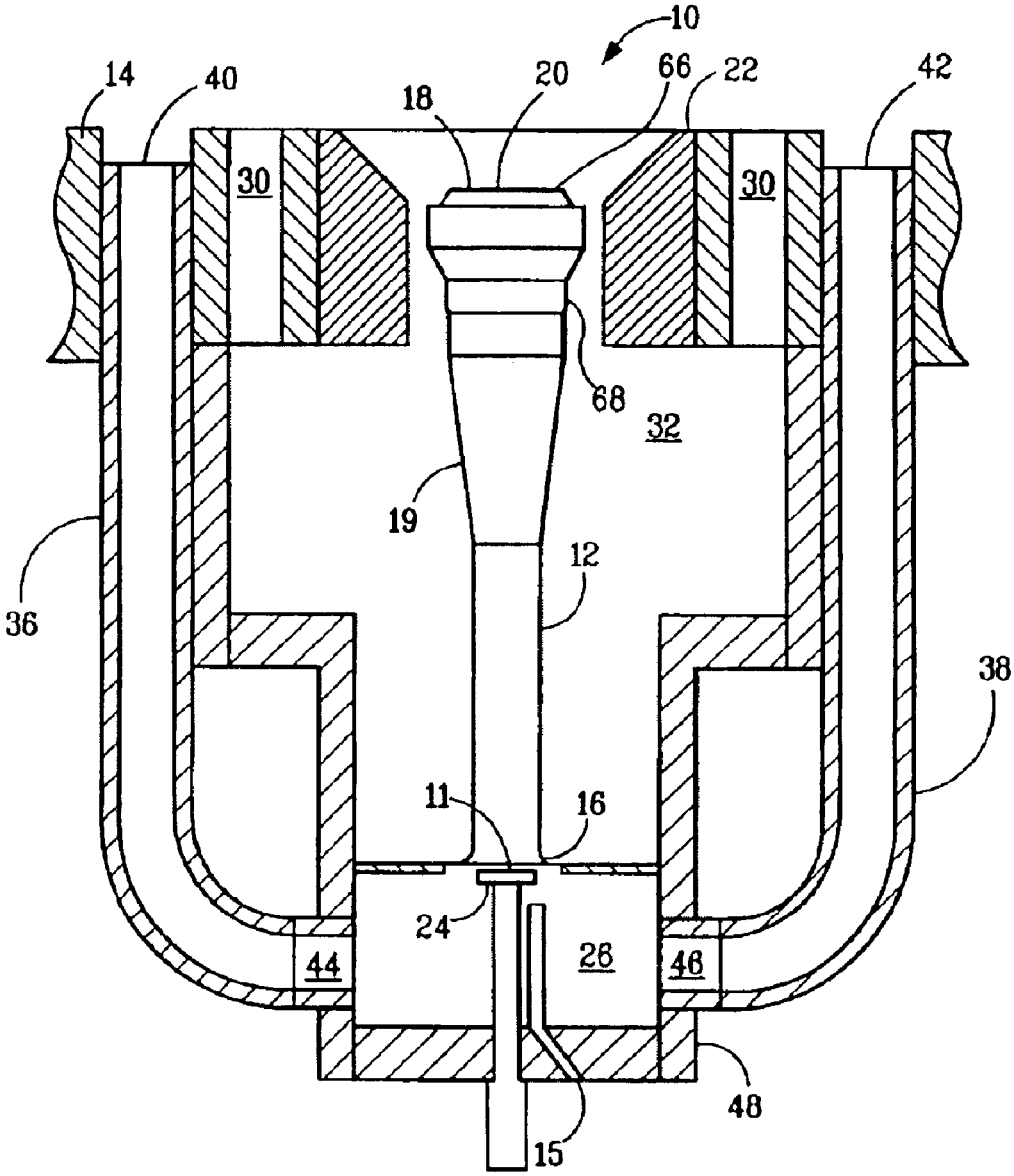
FIG. 2 is an elevation partly in section taken along line 2—2 of FIG. 1.
Figure 3:
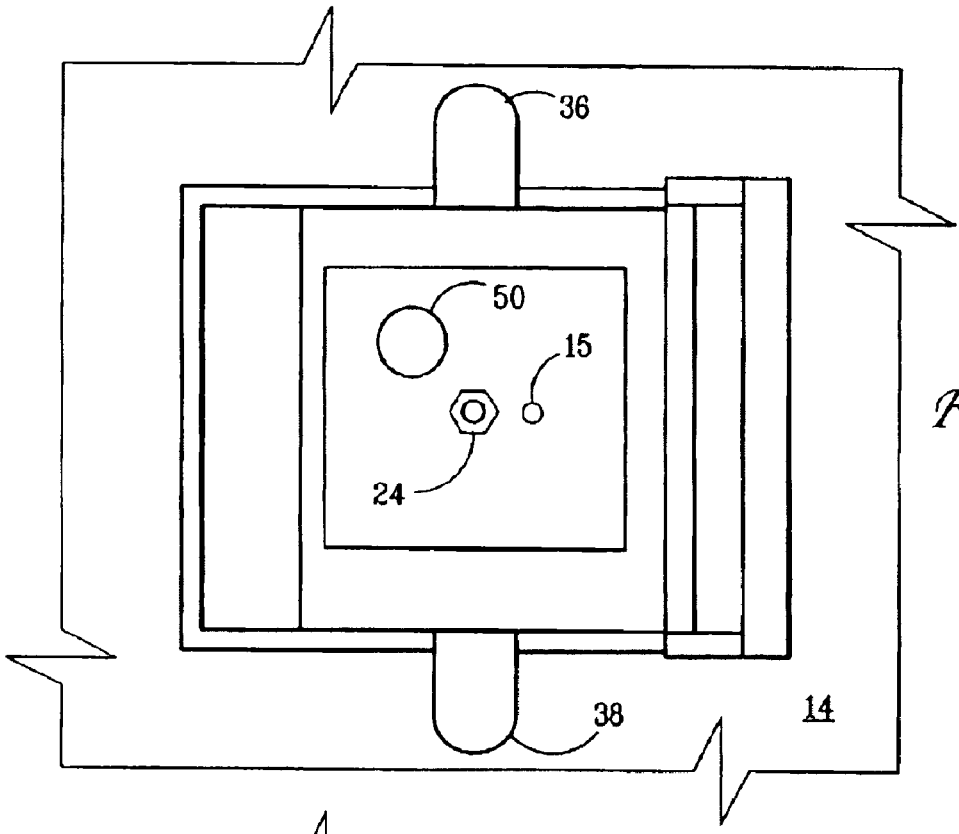
FIG. 3 is a plan view taken along line 3—3 of FIG. 1.
Figure 4:
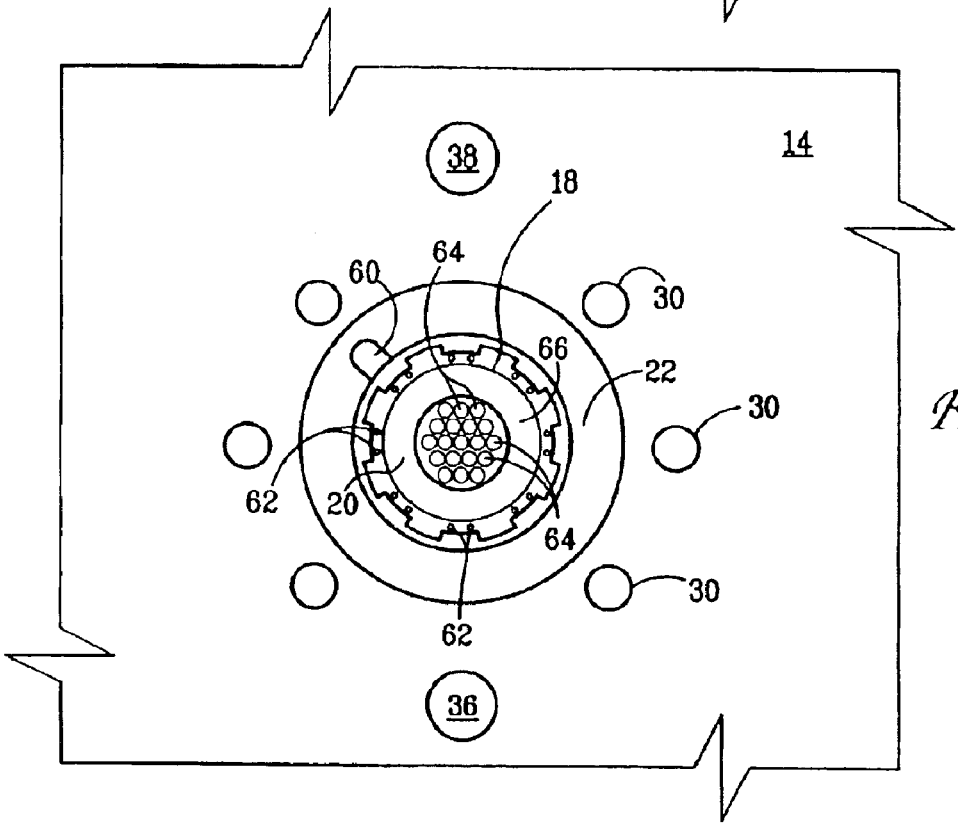
FIG. 4 is a plan view taken along line 4—4 of FIG. 1.
Figure 8A:
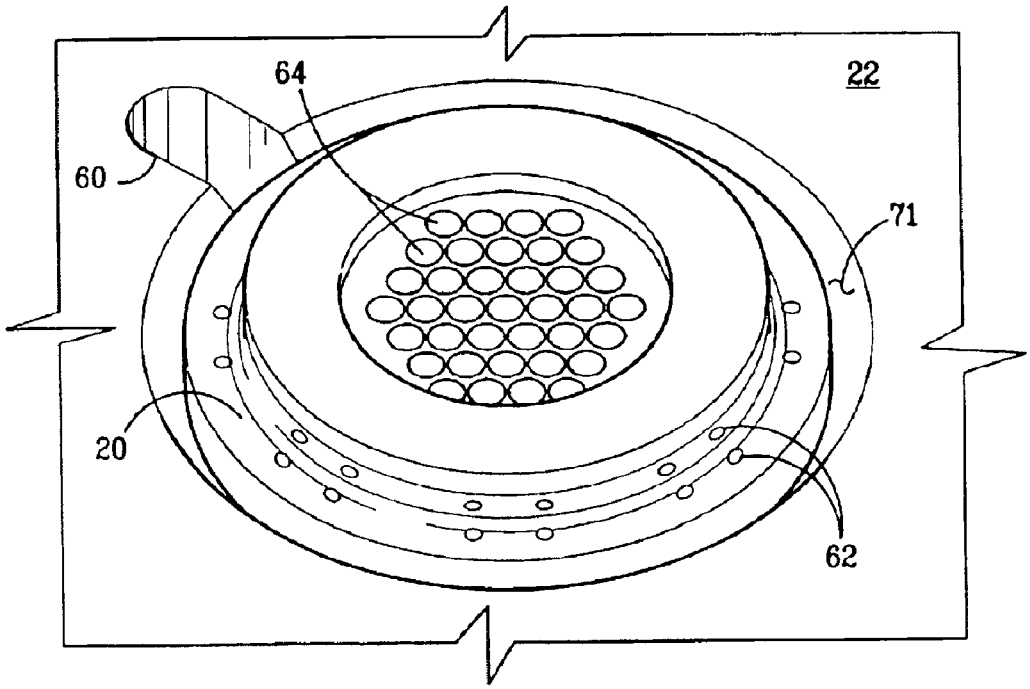
FIG. 8A is a perspective view of one embodiment of a burner tip.
Figure 8B:
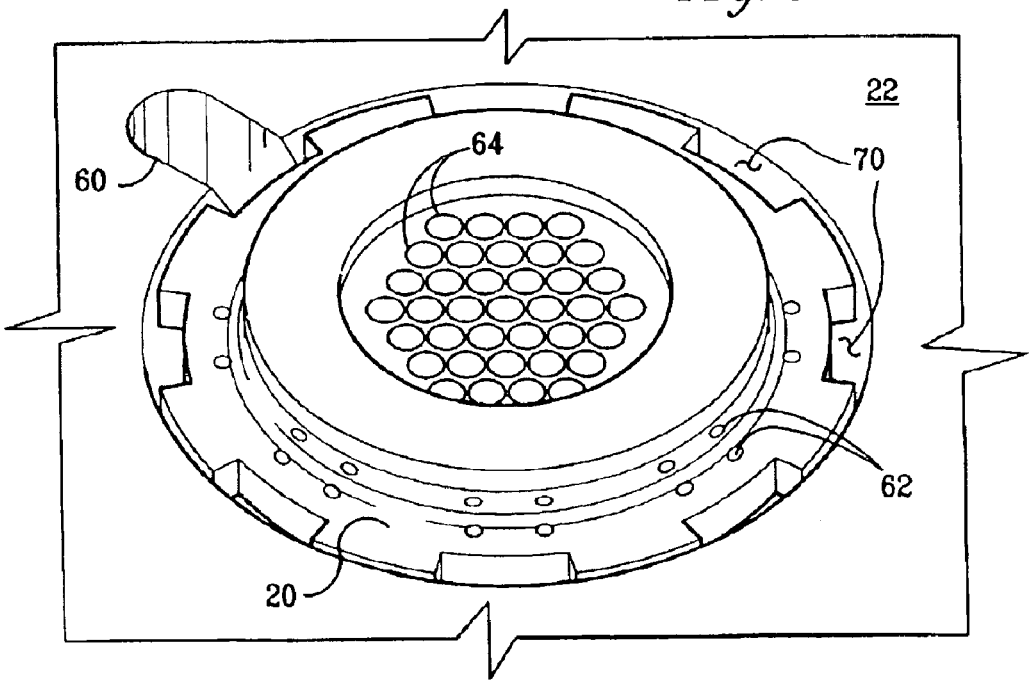
FIG. 8B is a perspective view of another embodiment of a burner tip.
Figure 9:
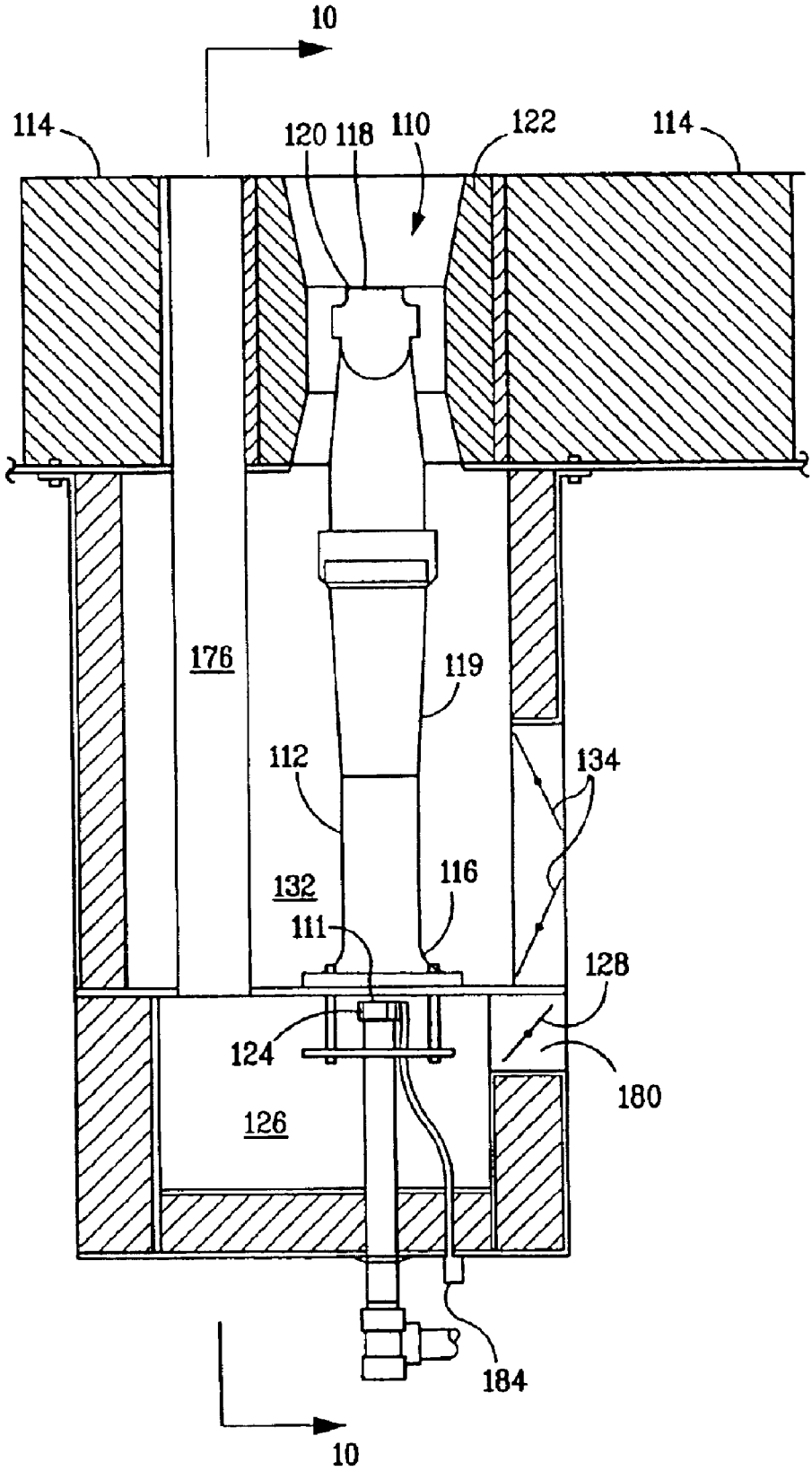
FIG. 9 illustrates an elevation view partly in section of an embodiment of a flat-flame burner.
Figure 10:
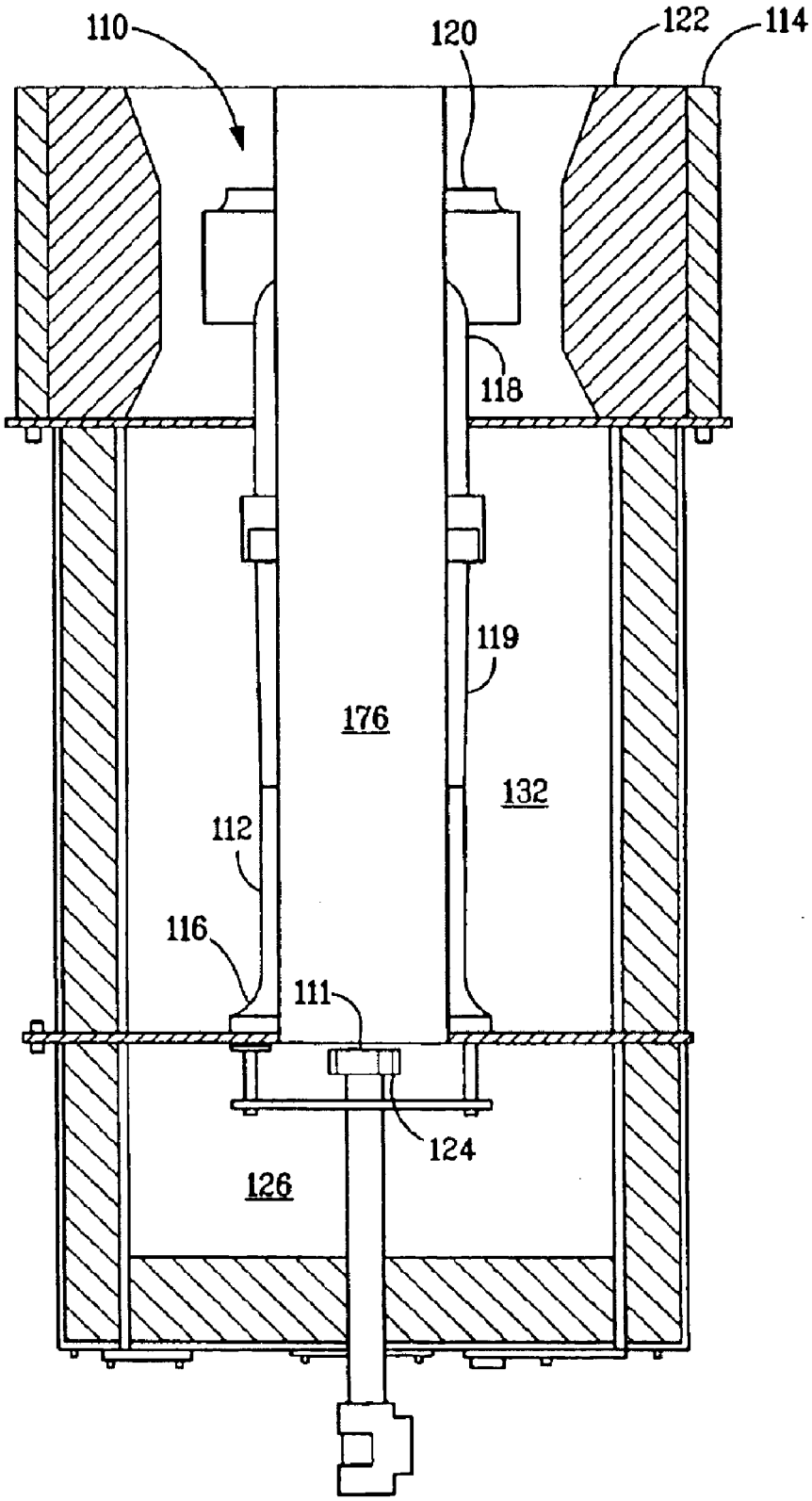
FIG. 10 is an elevation partly in section of the embodiment of a flat-flame burner of FIG. 9 taken along line 10—10 of FIG. 9.

As is shown in FIGS. 1 and 2 and in more detail in FIGS. 8A and 8B, a very small gap exists between the burner tip 20 and the burner tile 22. By keeping this gap small, the bulk of the secondary staged air is forced to enter the furnace through staged air ports 30 located some distance from the primary combustion zone, which is located immediately on the furnace side of the burner tip 20. This gap may be a single peripheral gap 71, as shown in FIG. 8A, or alternatively, comprise a series of spaced gaps 70 peripherally arranged, as shown in FIG. 8B.

It has been discovered through testing that increasing the at least one gap between the burner tip 20 and the burner tile 22 raises overall the $NO_x$ emissions produced by the burner, although it tends to also benefit flame stability. In view of its impact on $NO_x$ emissions, the at least gap between the burner tip 20 and the burner tile 22 must be precisely engineered.

A sight and lighting port 50 is provided in the burner plenum 48, both to allow inspection of the interior of the burner assembly, and to provide access for lighting of the burner through lighting chamber 60. As shown, the sight and lighting port 50 is aligned with lighting chamber 60, which is adjacent to the first opening in the furnace. Lighting chamber 60 is located at a distance from burner tip 20 effective for burner light off. A lighting torch or igniter (not shown) of the type disclosed in U.S. Pat. No. 5,092,761 has utility in the start-up of the burner of the present invention, as those skilled in the art will readily understand. To operate the burner of the present invention, the torch or igniter is inserted through light-off tube 50 into the lighting chamber 60, which is adjacent burner tip 20, to light the burner.

As may be appreciated, the burner plenum may be covered with mineral wool soundproofing and wire mesh screening to provide insulation therefor.

Figure 5:
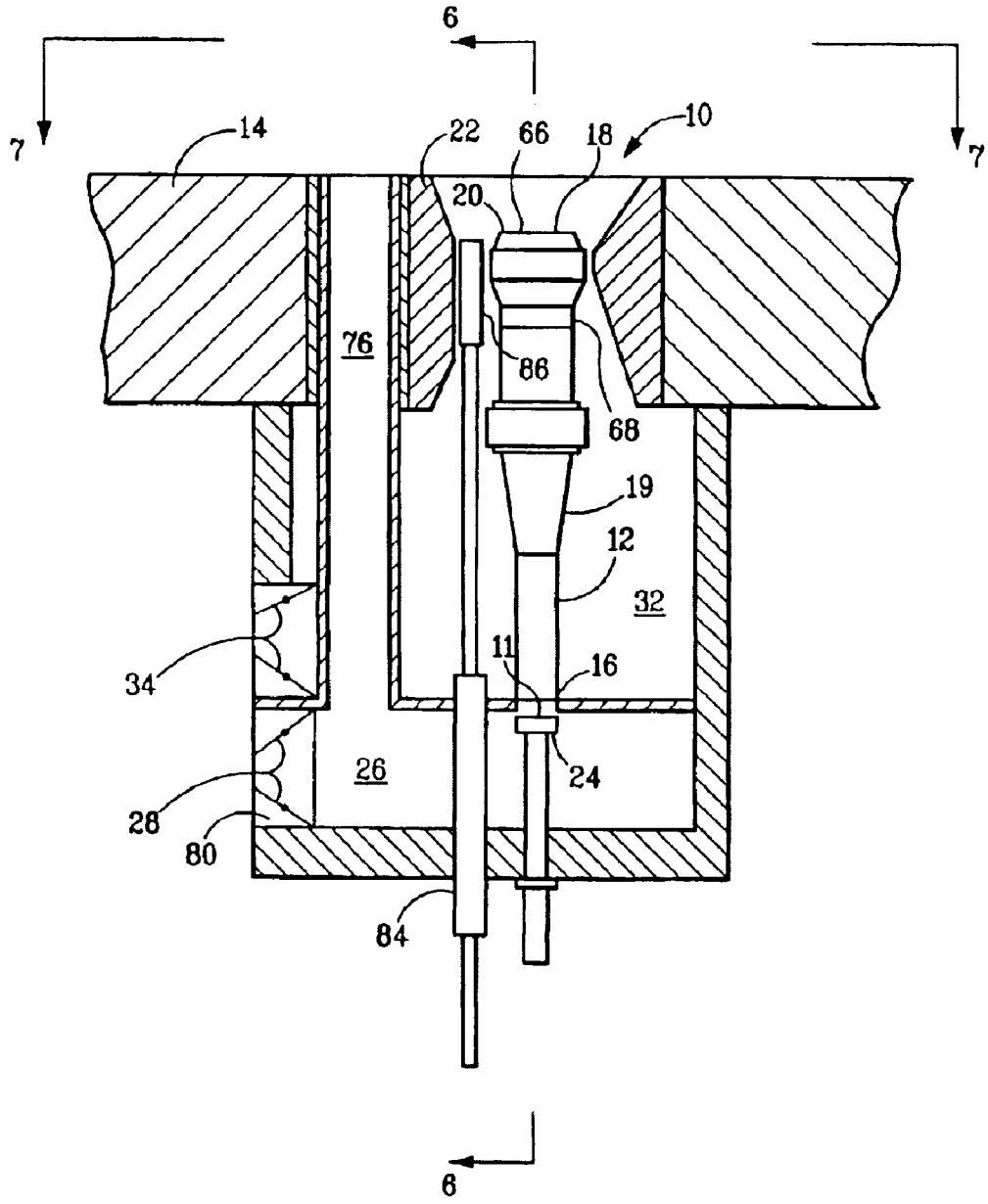
FIG. 5 is an elevation partly in section of a second embodiment of the premix burner of the present invention.
Figure 6:
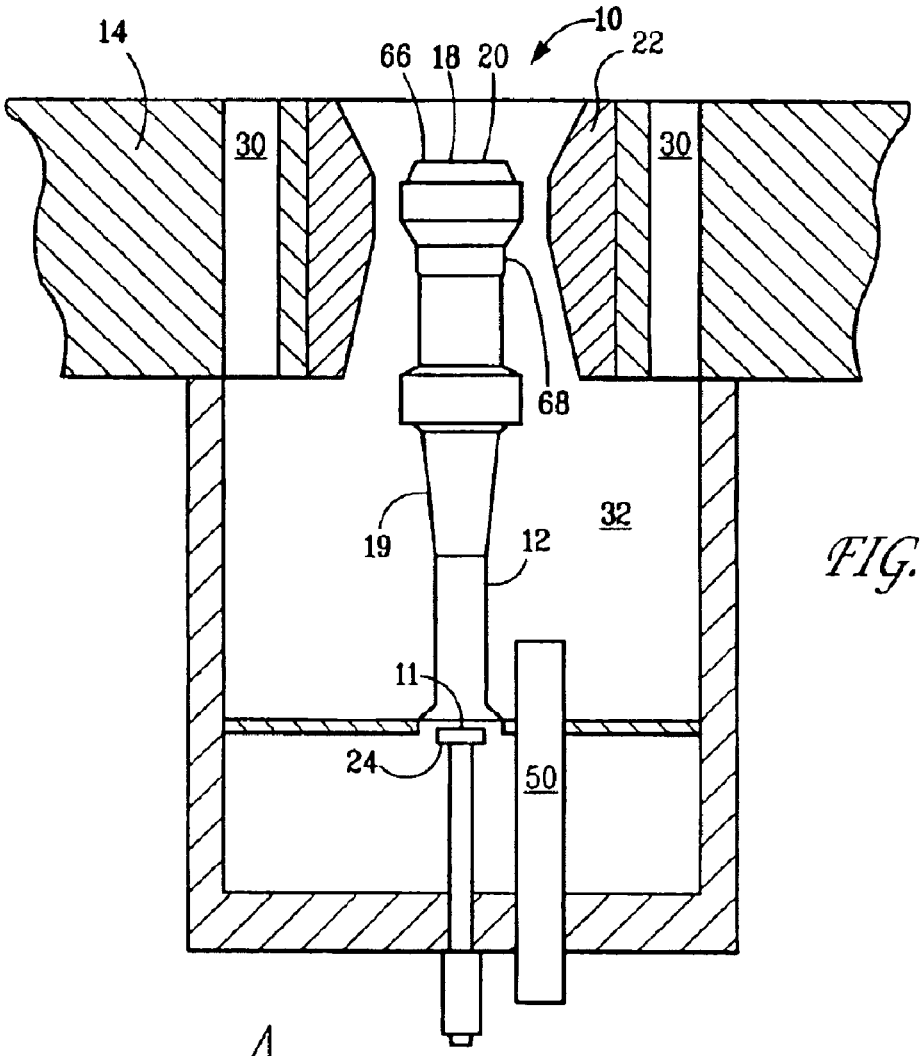
FIG. 6 is an elevation partly in section taken along line 6—6 of FIG. 5.
Figure 7:
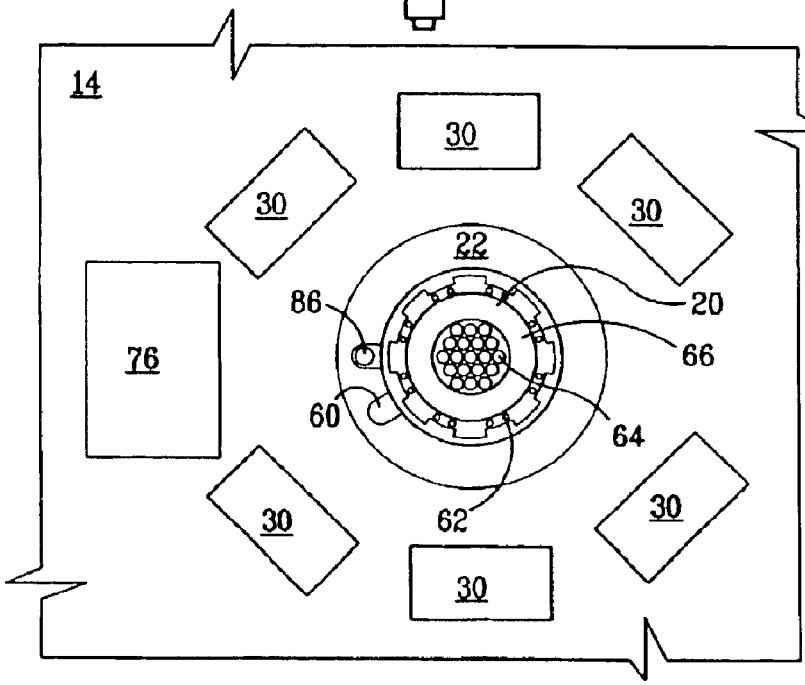
FIG. 7 is a plan view taken along line 7—7 of FIG. 5.

The burner tip of the present invention may also be used in a low $NO_x$ burner design of the type illustrated in FIGS. 5, 6 and 7, wherein like reference numbers indicate like parts. As with the embodiment of FIGS. 1 through 4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by a peripheral tile 22. A fuel orifice 11, which may be located within a gas spud 24 is located at upstream end 16 and introduces fuel gas into burner tube 12. Fresh or ambient air is introduced into primary air chamber 78 through adjustable damper 28 to mix with the fuel gas at upstream end 16 of burner tube 12. Combustion of the fuel gas and fresh air occurs downstream of burner tip 20.

As with the burner design illustrated in FIGS. 1 through 4, the burner of FIGS. 5 through 7 has a burner tip 20 which has an upper end 66, which when installed, faces the furnace box, and a lower end 68 adapted for mating with the burner tube 12. As previously described, lower end 68 of burner tip 20 may be mated to burner tube 12 by welding, swaging or threaded engagement, with welding or threaded engagement being particularly preferred. In operation, side-ports 62 direct a fraction of the fuel gas across the face of peripheral tile 22, while main ports 64 direct the major portion of the fuel gas into the furnace.

A plurality of air ports 30 originates in secondary air chamber 32 and pass through furnace floor 14 into the furnace. Fresh air enters secondary air chamber 32 through adjustable dampers 34 and passes through staged air ports 30 into the furnace to provide secondary or staged combustion.

In order to recirculate flue gas from the furnace to the primary air chamber, a flue gas recirculation passageway 76 is formed in furnace floor 14 and extends to primary air chamber 78, so that flue gas is mixed with fresh air drawn into the primary air chamber from opening 80. Flue gas containing, for example, about 6–10% $O_2$ is drawn through passageway 76 by the aspirating effect of fuel gas passing through venturi portion 19 of burner tube 12. As with the embodiment of FIGS. 1 through 4, the primary air and flue gas are mixed in primary air chamber 78, which is prior to the zone of combustion. Closing or partially closing damper 28 restricts the amount of fresh air that can be drawn into the primary air chamber 26 and thereby provides the vacuum necessary to draw flue gas from the furnace floor 14.

As with the embodiment of FIGS. 1 through 4, a mixture of approximately 50% flue gas and approximately 50% ambient air is drawn through flue gas recirculation passageway 76. The desired proportions of flue gas and ambient air may be achieved by proper sizing, placement and/or design of flue gas recirculation passageway 76 and air ports 30; that is, the geometry and location of the air ports may be varied to obtain the desired percentages of flue gas and ambient air.

Sight and lighting port 50 provides access to the interior of secondary air chamber 32 for a lighting torch or igniter (not shown). As with the embodiment of present invention depicted in FIGS. 1 through 4, a lighting torch or igniter of the type disclosed in U.S. Pat. No. 5,092,761 has utility in this embodiment of the present invention. Sight and lighting port 50 allows inspection of the interior of the burner assembly and access for lighting of the burner through lighting chamber 60. Sight and lighting port 50 is aligned with lighting chamber 60, which is adjacent to the first opening in the furnace. Lighting chamber 60 is located at a distance from burner tip 20 effective for burner light-off. Referring to FIG. 5, a tube 84 provides access to the interior of secondary air chamber 32 for an optional pilot 86.

To operate the burner of FIGS. 5 through 7, a torch or igniter is inserted through light-off tube 84 into the lighting chamber 60, which is adjacent primary combustion area and burner tip 20, to light the burner. In operation, a fuel orifice 11, which may be located within gas spud 24, discharges fuel into burner tube 12, where it mixes with primary air and recirculated flue-gas. The mixture of fuel gas, recirculated flue-gas and primary air then discharges from burner tip 20. The mixture in the venturi portion 19 of burner tube 12 is maintained below the fuel-rich flammability limit; i.e. there is insufficient air in the venturi to support combustion. Staged, secondary air is added to provide the remainder of the air required for combustion. The majority of the staged air is added a finite distance away from the burner tip 20 through staged air ports 30. However, a portion of the staged, secondary air passes between the burner tip 20 and the peripheral tile 22 and is immediately available to the fuel exiting the side ports 62. As indicated, side-ports 62 direct a fraction of the fuel across the face of the peripheral tile 22, while main ports 64, direct the major portion of the fuel into the furnace.

As may be envisioned, two combustion zones are established. A small combustion zone is established across the face of the peripheral tile 22, emanating from the fuel gas combusted in the region of the side-ports 62, while a much larger combustion zone is established projecting into the furnace firebox, emanating form the fuel gas combusted from the main ports 64. In operation, the larger combustion zone represents an approximately cylindrical face of combustion extending up from the burner, where the staged air flowing primarily from air ports 30 meets the fuel-rich mixture exiting from the burner tip main ports 64.

Analysis of burner performance has shown that the combustion zone adjacent to the side ports 62 and peripheral tile 22 is important in assuring flame stability. To provide adequate flame stability, the air/fuel mixture in this zone, which comprises the air/fuel mixture leaving the side ports 62 of burner tip 20, plus the air passing between the burner tip 20 and the peripheral tile 22, must be above the fuel-rich flammability limit.

While a mixture above the fuel-rich flammability limit in the combustion zone adjacent to the side ports 62 and peripheral tile 22 assures good burner stability, combustion in this zone has been found to generate relatively high $NO_x$ levels compared to larger combustion zone. It has been discovered that overall $NO_x$ emissions may be reduced by minimizing the proportion of fuel that is combusted in this smaller combustion zone. More particularly, it has been found that in a staged-air, pre-mix burner employing integral flue-gas recirculation, when the quantity of fuel discharged into the combustion zone adjacent to side ports 62 and peripheral tile 22 does not exceed about 15% of the total fuel fired in the burner, lower overall $NO_x$ emissions are experienced. This is achieved by further assuring that the air flow between burner tip 20 and the peripheral tile 22 is such that combustion takes place within this zone with a mixture sufficiently above the fuel-rich flammability limit to assure good burner stability, but without the high oxygen concentrations that lead to high $NO_x$ emissions.

The novel burner tip design of the present invention limits the fuel discharged into the combustion zone adjacent to the side ports 62 and peripheral tile 22 to about eight percent of the total fuel. This design advantageously maintains the desired air/fuel ratio in this combustion zone, while maintaining a burner-tip-to-peripheral-tile gap of between about 0.15" to about 0.40" for the staged, secondary air stream. As shown, rather than have two rows of about thirty side ports, as is common in conventional designs, the burner tip 20 of the present invention has two rows of 16 side ports 62, each side port having a diameter of about 6 mm. Advantageously, with this design, $NO_x$ emissions are reduced without the problems normally associated with reduced flame temperature and flame speed. The result is a very stable flame that is not prone to "lift-off." Reducing the diameter of the side ports 62 to about 5 mm also helps limit the fuel discharged into the combustion zone adjacent to the side ports 62 and peripheral tile 22 to between about 5 and 15 percent of the total fuel fired, while still producing a very stable flame.

A similar benefit can be achieved in flat-flame burners, as will now be described by reference to FIGS. 9, 10, 11A and 11B. A premix burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located within a gas spud 124, is located at upstream end 116 and introduces fuel gas into burner tube 112. Fresh or ambient air is introduced into primary air chamber 126 to mix with the fuel gas at upstream end 116 of burner tube 112. Combustion of the fuel gas and fresh air occurs downstream of burner tip 120. Fresh secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber from opening 180 through dampers 128. Flue gas containing, for example, 0 to about 15% $O_2$ is drawn through passageway 176 by the aspirating effect of fuel gas passing through venturi portion 119 of burner tube 112. Primary air and flue gas are mixed in primary air chamber 126, which is prior to the zone of combustion.

Figure 11A:
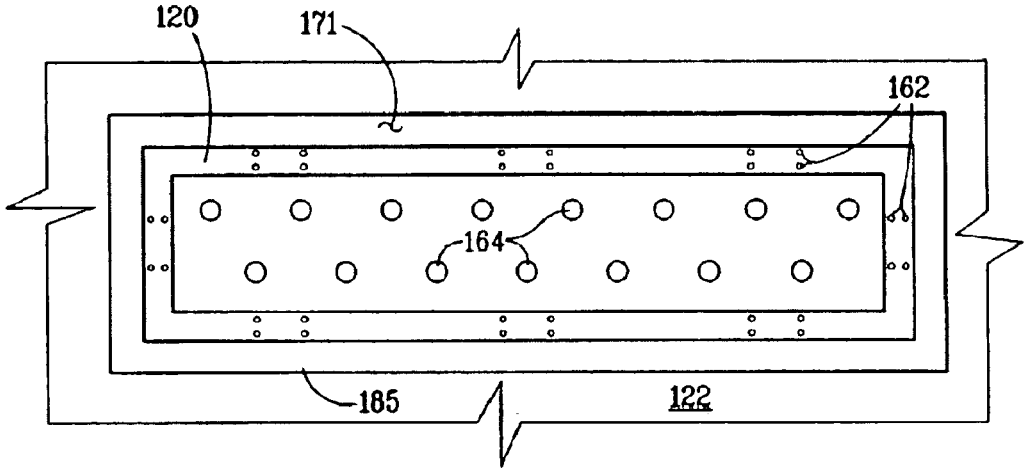
FIG. 11A is a top view of one embodiment of a burner tip for use in a flat-flame burner.
Figure 11B:
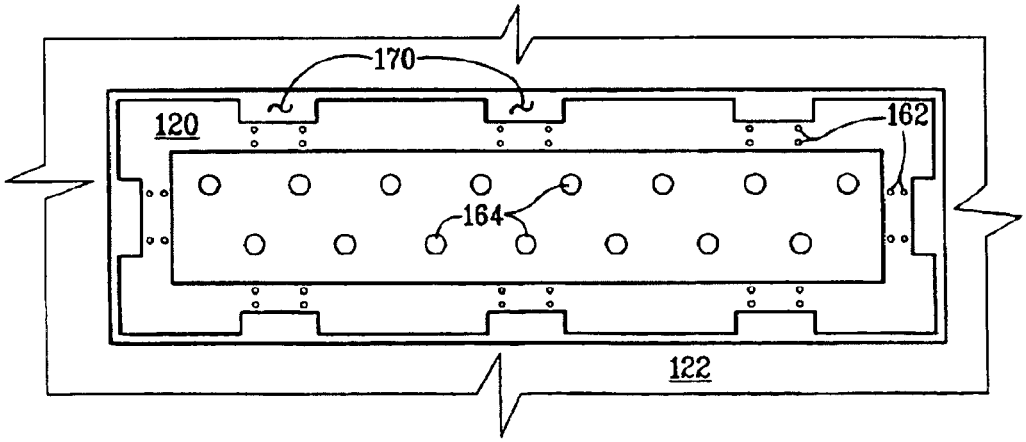
FIG. 11B is a top view of another embodiment of a burner tip for use in a flat-flame burner.

As is shown in FIGS. 11A and 11B, a very small gap exists between the burner tip 120 and the peripheral tile 122. By keeping this gap small, the bulk of the secondary staged air is forced to enter the furnace through staged air ports (not shown) located some distance from the primary combustion zone, which is located immediately on the furnace side of the burner tip 120. This gap may be peripheral gap 171 as shown in FIG. 11A, or alternatively, comprise a series of spaced gaps 170 peripherally arranged, as shown in FIG. 11B.

As previously noted, it has been discovered through testing that increasing the at least one gap between the burner tip 120 and the burner tile 122 raises overall the $NO_x$ emissions produced by the burner, although it tends to also benefit flame stability. In view of its impact on $NO_x$ emissions, the at least one gap between the burner tip 120 and the burner tile 122 must be precisely engineered.

In operation, a fuel orifice 111, which may be located within a gas spud 124, discharges fuel into burner tube 112, where it mixes with primary air and recirculated flue-gas. The mixture of fuel gas, recirculated flue-gas and primary air then discharges from burner tip 120. The mixture in the venturi portion 119 of burner tube 112 is maintained below the fuel-rich flammability limit; i.e. there is insufficient air in the venturi to support combustion. Staged, secondary air is added to provide the remainder of the air required for combustion. The majority of the staged air is added a finite distance away from the burner tip 120 through staged air ports (not shown). However, a portion of the staged, secondary air passes between the burner tip 120 and the peripheral tile 122 and is immediately available to the fuel exiting the side ports 162. As indicated, side-ports 162 direct a fraction of the fuel across the face of the peripheral tile 122, while main ports 164, direct the major portion of the fuel into the furnace.

Again, two combustion zones are established. A small combustion zone across the face of the peripheral tile 122, emanating from the fuel gas combusted in the region of the side-ports 162, while a much larger combustion zone is established projecting into the furnace firebox, emanating from the fuel gas combusted from the main ports 164. Analysis of burner performance has shown that the combustion zone adjacent to the side ports 162 and peripheral tile 122 is important in assuring flame stability. To provide adequate flame stability, the air/fuel mixture in this zone, which comprises the air/fuel mixture leaving the side ports 162 of burner tip 120, plus the air passing between the burner tip 120 and the peripheral tile 122, must be above the fuel-rich flammability limit.

While a mixture above the fuel-rich flammability limit in the combustion zone adjacent to the side ports 162 and peripheral tile 122 assures good burner stability, combustion in this zone has been found to generate relatively high $NO_x$ levels compared to the larger combustion zone. It has been discovered that overall $NO_x$ emissions may be reduced by minimizing the proportion of fuel that is combusted in this smaller combustion zone. More particularly, in a staged-air, pre-mix burner employing integral flue-gas recirculation, when the quantity of fuel discharged into the combustion zone adjacent to side ports 162 and peripheral tile 122 does not exceed about 15% of the total fuel fired in the burner, lower overall $NO_x$ emissions are expected. This is achieved by further assuring that the air flow between burner tip 120 and the peripheral tile 122 is such that combustion takes place within this zone with a mixture sufficiently above the fuel-rich flammability limit to assure good burner stability, but without the high oxygen concentrations that lead to high $NO_x$ emissions.

As those skilled in the art recognize, the reduction in the number of side ports necessary to achieve the objects of the present invention is dependant upon a number of factors including the properties of the fuel, itself, the dynamics of fluid flow and the kinetics of combustion. While the burner tips of the present invention present designs having about a 53% reduction in the number of side ports, it would be expected that reductions in the number of side ports ranging from about 25% to about 75% could be effective as well, so long as each side port and the burner-tip-to-peripheral-tile gap is appropriately sized.

In the burner tip designs of the present invention, preferably the dimensions of the burner-tip-to-peripheral-tile gap are such that the total air available to the fuel gas exiting the side ports (i.e. the sum of air exiting the side ports with the fuel gas, plus the air supplied through gap), is between about 5 to about 15 percentage points above the Fuel Rich Flammability Limit for the fuel being used. For example, if the fuel being used has a Fuel Rich Flammability Limit of 55% of the air required for stoichiometric combustion, the air available to the fuel gas exiting the side ports should represent 60–65% of the air required for stoichiometric combustion.

Unlike prior designs, use of the burner tip of the present invention serves to substantially minimize localized sources of high $NO_x$ emissions in the region near the burner tip, as demonstrated by the Examples below.

In addition to the use of flue gas as a diluent, another technique to achieve lower flame temperature through dilution is through the use of steam injection. Steam can be injected in the primary air or the secondary air chamber. (See, for example, steam injection tube(s) 15 of FIG. 2 and steam injection tube 184 of FIG. 9). Preferably, steam may be injected upstream of the venturi.

EXAMPLES

To assess the benefits of the present invention, computational fluid dynamics, CFD, were used to evaluate the configurations described below. A CFD analysis solves fundamental controlling equations and provides fluid velocity, species, combustion reactions, pressure, heat transfer and temperature values, etc. at every point in the solution domain. FLUENT™ software from Fluent Inc. was used to perform the analysis. (Fluent, Inc., USA, 10 Cavendish Court, Centerra Resource Park, Lebanon, N.H., 03766-1442).

Example 1

In order to demonstrate the benefits of the present invention, the operation of a pre-mix burner employing a burner tip and flue gas recirculation system of the type described in U.S. Pat. No. 5,092,761 (as depicted in FIG. 5 of U.S. Pat. No. 5,092,761), was simulated to establish the baseline data using the FLUENT software package.

Example 2

In Example 2 the burner tip of the present invention is employed, with the same material balance maintained as in the existing burner. The temperature profile for the detailed material and energy balance calculated using the FLUENT computational fluid dynamics software showed a temperature profile that was, on average, lower than the profile exhibited by the configuration of Example 1. Experience has shown that this can be expected to reduce the $NO_x$ emissions of the burner.

Example 3

To further demonstrate the benefits of the present invention, a pre-mix burner, employing a burner tip in accordance with a preferred embodiment of the present invention was tested, wherein the fuel gas discharged from the burner tip during combustion from the peripherally arranged side ports was about 10 percent of the total fuel gas combusted. The burner of this example also employing flue gas recirculation of the type described in U.S. Pat. No. 5,092,761 (as depicted in FIG. 5) and was operated at a firing rate of 6 million BTU/hr., using a fuel gas comprised of 30% $H_2$/70% natural gas, without steam injection.

A very stable flame was observed, with $NO_x$ emissions measured at 49 ppm.

Example 4

In this example, the pre-mix burner of Example 3 was used. Once again, the burner employed flue gas recirculation of the type described in U.S. Pat. No. 5,092,761 and was operated at a firing rate of 6 million BTU/hr., using a fuel gas comprised of 30% $H_2$/70% natural gas, with steam injected at a rate of 132 lb./hr.

A very stable flame was observed, with $NO_x$ emissions measured at 30 ppm.

Example 5

In this example, a pre-mix burner, employing a burner tip in accordance with another preferred embodiment of the present invention was tested, wherein the fuel gas discharged during combustion from the peripherally arranged side ports of the burner tip was about 5 percent of the total fuel gas combusted. The burner tested also employed flue gas recirculation of the type described in U.S. Pat. No. 5,092,761 (as depicted in FIG. 5) and was operated at a firing rate of 6 million BTU/hr., using a fuel gas comprised of 30% $H_2$/70% natural gas, without steam injection.

A less stable flame than that of Example 3 was observed, with $NO_x$ emissions measured at 45 ppm, for an 8% reduction over the: burner design tested in Example 3.

Example 6

In this example, the pre-mix burner of Example 5 was used. Once again, the burner employed flue gas recirculation of the type described in U.S. Pat. No. 5,092,761 and was operated at a firing rate of 6 million BTU/hr., using a fuel gas comprised of 30% $H_2$/70% natural gas, with steam injected at a rate of 132 lb./hr.

A less stable flame than that of Example 3 was observed, with $NO_x$ emissions measured at 28 ppm, for a 7% reduction over the burner design tested in Example 4.

It is to be understood that the burner tip designs described herein also have utility in traditional raw gas burners and raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed, with very satisfactory results.

n addition to the use of flue gas as a diluent, another technique to achieve lower flame temperature through dilution is through the use of steam injection. Steam can be injected in the primary air or the secondary air chamber. Preferably, steam may be injected upstream of the venturi.

As may be appreciated by those skilled in the art, the present invention can be incorporated in new burners or can be retrofitted into existing burners.

Although illustrative embodiments have been shown and described, a wide range of modification change and substitution is contemplated in the foregoing disclosure and in some instances, some features of the embodiment may be employed without a corresponding use of other features. Accordingly, it is appropriate that the appended claims be construed broadly and in a manner consistent with the scope of the embodiments disclosed herein.

What is claimed is:

1. A burner for the combustion of fuel gas in a furnace, said burner comprising:

(a) a burner tube having a longitudinal axis and having a downstream end and an upstream end for receiving fuel gas and air, flue gas or mixtures thereof;

(b) a fuel orifice located adjacent the upstream end of said burner tube, for introducing fuel gas into said burner tube;

(c) a burner tip mounted on the downstream end of said burner tube and adjacent a first opening in the furnace, said burner tip having a plurality of main ports substantially aligned with said longitudinal axis of the burner tube, and a plurality of peripherally arranged side ports; and (d) a peripheral tile which peripherally surrounds said burner tip, said peripheral tile providing at least one gap between an outer periphery of said burner tip and said peripheral tile, said at least one gap effective for providing a portion of the air for combustion wherein the quantity of fuel gas discharged during combustion from said peripherally arranged side ports does not exceed 15% of the total fuel gas combusted.

2. The burner according to claim 1, wherein the dimension of the burner-tip-to-peripheral-tile gap is such that the total air available to the fuel gas exiting the side ports is between about 5 to about 15 percentage points above a Fuel Rich Flammability Limit for the fuel gas being used.

3. The burner according to claim 2, wherein the fuel gas discharged during combustion from said peripherally arranged side ports is between about 5 to about 15 percent of the total fuel gas combusted.

4. The burner according to claim 1, wherein the fuel gas discharged during combustion from said peripherally arranged side ports is between about 5 to about 15 percent of the total fuel gas combusted.

5. The burner according to claim 2, wherein the fuel gas discharged during combustion from said peripherally arranged side ports is about ten percent of the total fuel gas combusted.

6. The burner according to claim 1, wherein the fuel gas discharged during combustion from said peripherally arranged side ports is about ten percent of the total fuel gas combusted.

7. The burner according to claim 6, wherein the at least one burner-tip-to-peripheral-tile gap is between about 0.15 to about 0.40 inches.

8. The burner according to claim 4, wherein the at least one burner-tip-to-peripheral-tile gap is between about 0.15 to about 0.40 inches.

9. The burner according to claim 1, wherein the at least one burner-tip-to-peripheral-tile gap is between about 0.15 to about 0.40 inches.

10. The burner according to claim 1, wherein said fuel orifice is located within a gas spud.

11. The burner of claim 1, further comprising a steam injection tube for injecting steam upstream of said burner tube.

12. The burner of claim 1, wherein said burner is a flat-flame burner.

13. The burner of claim 1, wherein said burner is a pre-mix burner.

14. A method for combusting fuel in a burner of a furnace, comprising the steps of:

(a) combining fuel gas and air, flue gas or mixtures thereof at a predetermined location adjacent a fuel orifice;

(b) passing the fuel gas and air, flue gas or mixtures thereof through a burner tube;

(c) discharging the fuel gas and air, flue gas or mixtures thereof at a burner tip downstream of the predetermined location, the burner tip having a plurality of main ports substantially aligned with the longitudinal axis of the burner tube, arranged on an upper surface thereof, and a plurality of peripherally arranged side ports, the burner tip peripherally surrounded by a peripheral tile; and (d) combusting said fuel gas downstream of the burner tip downstream of said predetermined location;

wherein the quantity of fuel gas discharged during combustion from said peripherally arranged side ports does not exceed 15% of the total fuel gas combusted.

15. The method according to claim 14, further comprising the step of providing at least one gap between an outer periphery of said burner tip and the peripheral tile, each of the at least one gap effective for providing a portion of the air for combustion.

16. The method according to claim 15, wherein the dimension of the at least one burner-tip-to-peripheral-tile gap is such that the total air available to the fuel gas exiting the side ports is between about 5 to about 15 percentage points above a Fuel Rich Flammability Limit for the fuel gas being combusted.

17. The method according to claim 16, wherein the fuel gas discharged during combustion from the peripherally arranged side ports is about ten percent of the total fuel gas combusted.

18. The method according to claim 17, further comprising the step of drawing a stream of flue gas from the furnace.

19. The method according to claim 18, wherein the stream of flue gas drawn from the furnace is drawn in response to the aspirating effect of uncombusted fuel gas exiting the fuel orifice and flowing towards said combustion zone.

20. The method according to claim 19, further comprising the step of mixing air having a temperature lower than the temperature of the flue gas with the stream of flue gas and drawing the mixture of the lower temperature air and flue gas, to said predetermined location, to thereby lower the temperature of the drawn flue gas.

21. The method according to claim 20, wherein said drawing step includes passing the fuel gas and air, flue gas or mixtures thereof; through a venturi, whereby the aspirating effect of the uncombusted fuel gas exiting the fuel orifice and flowing through said venturi draws the flue gas and lower temperature air into the venturi.

22. The method according to claim 15, wherein the fuel gas discharged during combustion from said peripherally arranged side ports is between about 5 to about 15 percent of the total fuel gas combusted.

23. The method according to claim 15, wherein the at least one burner-tip-to-peripheral-tile gap is between about 0.15 to about 0.40 inches.

24. The method according to claim 14, wherein the fuel orifice is located within a gas spud.

25. The method according to claim 14, further comprising the step of injecting steam upstream of the burner tube.

26. The method according to claim 14, wherein the burner is a pre-mix burner.

27. The method according to claim 14, wherein the burner is a flat-flame burner.

28. The method according to claim 14, wherein the burner is installed in a steam-cracking furnace.

* * * * *